United States Patent [19]

Asp et al.

[11] 4,257,838

[45] Mar. 24, 1981

[54] PROCESS AND APPARATUS FOR THE MANUFACTURE OF DISPOSABLE PHARMACEUTICAL SINGLE-DOSE CONTAINERS

[75] Inventors: Peter Asp, Biberach van der Riss; Dieter Jarsen, Laupheim; Heinrich Eggert, Biberach van der Riss; Wilhelm Klingelhöller, Mettenberg,Bibrrach, all of Fed. Rep. of Germany

[73] Assignee: Boehringer Ingelheim GmbH, Ingelheim am Rhein, Fed. Rep. of Germany

[21] Appl. No.: 28,375

[22] Filed: Apr. 9, 1979

Related U.S. Application Data

[63] Continuation of Ser. No. 901,683, May 1, 1978, abandoned, which is a continuation of Ser. No. 788,838, Apr. 19, 1977, abandoned, which is a continuation of Ser. No. 695,091, Jun. 11, 1976, abandoned, which is a continuation of Ser. No. 447,495, Mar. 4, 1974, abandoned.

[30] Foreign Application Priority Data

Mar. 3, 1973 [DE] Fed. Rep. of Germany ..... 2310787

[51] Int. Cl.[3] ..... A61M 7/00; A61J 7/00

[52] U.S. Cl. ..... 156/439; 53/412; 53/463; 53/477; 128/213 R; 128/272; 156/440; 156/553; 206/530; 206/532; 424/14

[58] Field of Search ..... 156/66, 69, 70, 290–294, 156/298, 303.1, 439, 440, 553, 145–147, 306, 361, 382; 128/272, 213, 233; 53/14, 134, 412, 416, 463, 464, 477–479; 424/14, 18; 206/15, 528, 530, 532, 534.2; 428/35; 264/4, 88, DIG. 37; 425/804

[56] References Cited

U.S. PATENT DOCUMENTS

| | | | |
|---|---|---|---|
| 2,467,565 | 4/1949 | Owens et al. | 156/267 |
| 2,594,093 | 4/1952 | Thompson | 128/272 |
| 3,031,733 | 5/1962 | Ljung et al. | 156/439 |
| 3,276,669 | 10/1966 | Vilutis | 53/412 |
| 3,316,686 | 5/1967 | Welin-Berger | 53/413 |
| 3,405,502 | 10/1968 | Badder | 156/361 |
| 3,607,563 | 9/1971 | Bagnall | 156/439 |
| 3,639,954 | 2/1972 | Kirzinger et al. | 156/439 |
| 3,644,165 | 2/1972 | Chen | 156/439 |
| 3,840,413 | 10/1974 | Bylund | 156/298 |
| 3,930,500 | 1/1976 | Mohrko et al. | 128/233 |
| 3,991,758 | 11/1976 | Mohrke et al. | 128/233 |

*Primary Examiner*—John E. Kittle
*Attorney, Agent, or Firm*—Hammond, Littell, Weissenberger & Muserlian

[57] ABSTRACT

Apparatus for manufacturing pharmaceutical single-dose containers with opening threads, including a thread introduction device in conjunction with a presealing station, where the thread introduction device is mounted so as to be movable in the direction of the presealing station and comprises thread transporting means, thread cutting means and time synchronization control means for the individual devices in such a way that first the foil strip is advanced by a particular unit, then the thread introduction device is moved in the direction of the presealing station and the threads are introduced into a number of single dose containers, followed by the sealing of the halves of the single-dose containers in adjacent areas with simultaneous sealing of part of the threads, and finally the threads are cut from the thread strand or the pre-cut threads are taken from the guide channel, whereupon the thread introduction device is moved out again and the foil strip is transported further.

6 Claims, 12 Drawing Figures

A
B
1
2
3
15
29

3
6
7
9
11
15
25
27
29
30
31
33
35
39

PROCESS AND APPARATUS FOR THE MANUFACTURE OF DISPOSABLE PHARMACEUTICAL SINGLE-DOSE CONTAINERS

This is a continuation of copending application Ser. No. 901,683, filed May 1, 1978, now abandoned; which in turn is a continuation of application Ser. No. 788,838, filed Apr. 19, 1977, now abandoned; which in turn is a continuation of application Ser. No. 695,091, filed June 11, 1976, now abandoned; which in turn is a continuation of application Ser. No. 447,495, filed Mar. 4, 1974, now abandoned.

This invention relates to a novel apparatus and process for the manufacture of disposable pharmaceutical single-dose containers comprising an opening thread.

BACKGROUND OF THE INVENTION

Disposable single-dose containers, for example made of deep-drawn plastic, for one-time discharge of the contents are becoming increasingly more preferred by the pharmaceutical industry for sanitary as well as other reasons. Examples of suitable pharmaceutical compositions with which such containers may be filled are solutions, ointments, emulsions, syrups and powders. In order to facilitate the discharge of the contents, a thread is simultaneously sealed into the discharge channel during the sealing step of the container manufacturing process. After completion of the sealing step, one end of the thread extends into the interior of the single-dose container, its middle portion fills the discharge channel of the container, and the other end is sealed in a severable closure in which the discharge channel terminates. When the severable closure is twisted or broken off, which may be facilitated by means of score lines or the like, the thread is simultaneously withdrawn from the discharge channel, so that the contents of the container can be expelled therefrom by applying pressure to the sides of the container.

For the manufacture of such pharmaceutical single-dose containers with opening threads, two endless foil ribbons which are coated with a plastic layer capable of being sealed are passed in parallel relationship, with the plastic layers facing each other, through a pre-shaping device, where the two mirror image symmetrical halves of the container are formed by stamping or deep-drawing, for example. The foil ribbons then pass on over guide means, such as rollers, to a preliminary sealing station to which the opening thread insertion device is attached. In this preliminary sealing station the opening thread is inserted, and the outer edges of the pre-shaped container halves on the foil ribbons are sealed together, except for a portion in the upper section which must remain open to permit subsequent filling of the container; the opening thread is also partially sealed in during this operation. Thereafter, the protruding thread ends can be cut to the predetermined length; alternatively, in conjunction with suitable feeding means, the thread can be premeasured to the desired length, for instance by cutting or notching. Subsequently, the unit of partly sealed containers, which are still open at the top, pass to the filling station where they are filled. The units then advance into the final sealing station where the filling aperture is sealed and the threads can, if desired, be hermetically sealed in, thereby preventing an escape of, for example, a liquid product as a result of capillaries along the thread. In a further apparatus (stamping station) the individual containers receive their final appearance by stamping.

THE INVENTION

The present invention relates mainly to the thread introduction device in conjunction with the presealing station, and to the co-operation of these two devices during thread introduction and pre-sealing. The thread introduction device is located adjacent to the pre-sealing station. The thread introduction device is movable in the direction of the pre-sealing station. This movement is effected in that the thread introduction device is slidably mounted on bearings which are provided with bearing bushings on guide rods which are firmly connected with the packing machine. This arrangement permits a parallel upward and downward movement of the device, for example by means of a cam or a cam plate which take their rotary movements from the packing machine drive, for example. The upward and downward movement can also take place by means of a pneumatic or hydraulic cylinder controlled by the machine or electromagnetically.

The thread introduction device comprises a thread transporting system and a cutting mechanism. The drive movement necessary for the complete device is also, for example, taken from the packing machine drive via a shaft or cams. It is important in this connection that the individual movements take place completely synchronously. When a new portion of the foil strip reaches the pre-sealing station with the pre-shaped but initially half single-dose containers, then first the thread introduction device is raised into the operating position by means of the arrangement mentioned hereinbefore. By means of thread drive rollers, which are moved relative to one another in pairs, the threads are advanced by the requisite length. The threads are guided through nozzles provided with rounded collecting openings, which permits self-threading and an accurate guidance. The upper ends of the threads then passes into the inner area of the pre-shaped, but not yet sealed, single-dose container halves. A thread collecting tube is placed on the nozzle prior to the start of threadfeed in the case of threads which are difficult to guide. This tube is guided in a tongue on the corresponding foil edge and also receives its lifting movement from the machine by means of a suitable control device, such as a cam plate. It has a conical opening which permits a trouble-free fitting of the thread during thread feed. After the thread feed, which introduces the thread into the tube, has taken place the tube is moved backwards in a first stroke until the following sealing can take place. The sealing jaws of the pre-sealing apparatus close and weld together the symmetrically guided two foils to the surfaces at the bottom and sides which border the pre-shaped single-dose containers. As the threads are now welded into the foils the desired thread length can be cut from the wound strand by means of a special knife, or a pre-cut or pre-sliced thread can be removed in its entirety from the guidance channel. Simultaneously, the thread collecting tube contracts completely from the sealed area into the tongue. Now the device is lowered again by means of the arrangement mentioned hereinbefore, the foil is moved forward by a prescribed number of units, so that a new working cycle can follow.

The length of the threads introduced into the single dose containers can for example be determined by the size of the angle of a toothed segment or by the stroke of a rack. Instead of a toothed segment, it is possible in principle to use any other intermittently engaging power transmission system, such as a cam controlled by the machine movement. In another embodiment, said toothed segment or rack drives a pinion which is coupled with further pinions. The pinions are mounted rigidly on axles on which the thread drive rollers are fitted. In place of pinions, it is, of course, possible to use friction wheels. As a result, the thread drive rollers are moved relative to one another and therefore transport the threads by the desired cutting lengths. After pre-sealing, as stated hereinbefore, the necessary thread length is cut from the wound strand or removed from the thread guide channel when precutting has taken place. The thread is cut by means of a special knife system comprising, for example, an upper and a lower knife portion, where both portions are provided with cutting holes and are so mounted above or in one another that during the thread introduction process the cutting holes in the individual pairs of knives are located above the thread drive rollers through which the thread is then passed. After pre-sealing, the knives mounted in the knife holders are moved apart or rotated relative to one another so that, for example, the upper knife is displaced to the left and the lower knife to the right. The cutting holes which were previously precisely superimposed are thereby displaced by the same amount in the opposite direction, or the bolt is rotated relative to the cutting tube, whereby the threads are centered and cut off. In one embodiment, for example, a spindle is provided on each of the two knife holders, where the spindles are interconnected by a spring. Each of the two spindles comprises a ball bearing which is rotatable about the same. A cam which is driven synchronously with the drive system on rotation drives the two ball bearings away from one another counter to the spring tension, so that the knife holders are also moved apart, whereby the cutting holes of the knives cut the thread. Upon further rotating the cam, the knife holders are again moved together by the spring and brought into the initial position. As already stated, in another embodiment a bolt which rotates in a cutting tube is used in place of the knives. During the cutting process a corresponding cam brings about a slight angular rotation of the bolt which leads to the cutting off of the thread on the cutting tubes. So that cutting only takes place at the top, the bottom of the bolt is provided with conical holes and the cutting tube is provided with slots. According to a further embodiment, the cutting movement of the knife is controlled by a cam plate, for example. Re-setting can be effected by a spring. According to this process, the thread introduction device is moved by the arrangement mentioned hereinbefore out of the foil area and the foil is again advanced by a corresponding unit.

For better comprehension, the following synchronously connected processes are described again in the correct sequence longitudinal: advance of the foil strip by a particular unit, transverse movement of thread introduction device towards the presealing station, introduction of the threads wires or into the pockets of the single-dose containers or into the thread collecting tubes, optionally followed by the retraction of the thread collecting tube, presealing of the two halves of the single-dose container with simultaneous sealing in of part of the thread in the discharge channel, cutting sections from the thread, optional retraction of the thread collecting tube to the final stage, retraction of the thread introduction device, and further longitudinal transportation of the foil strip by the prescribed length.

The apparatus for performing the process according to the present invention is shown in the attached drawings, of which FIG. 1 shows a perspective view of the thread introduction device for equipping single-dose containers with opening threads;

FIG. 2 shows a longitudinal section of FIG. 1 in the plane AB;

FIG. 3 shows in plan view the pre-sealing jaws and the two synchronously moving pre-shaped foil strips during introduction of the threads; FIG. 3*b* during pre-sealing and FIG. 3*c* after pre-sealing and prior to the further transportation of the foil strips by a particular unit length. In this phase the thread introduction device is lowered again;

Figure 1:
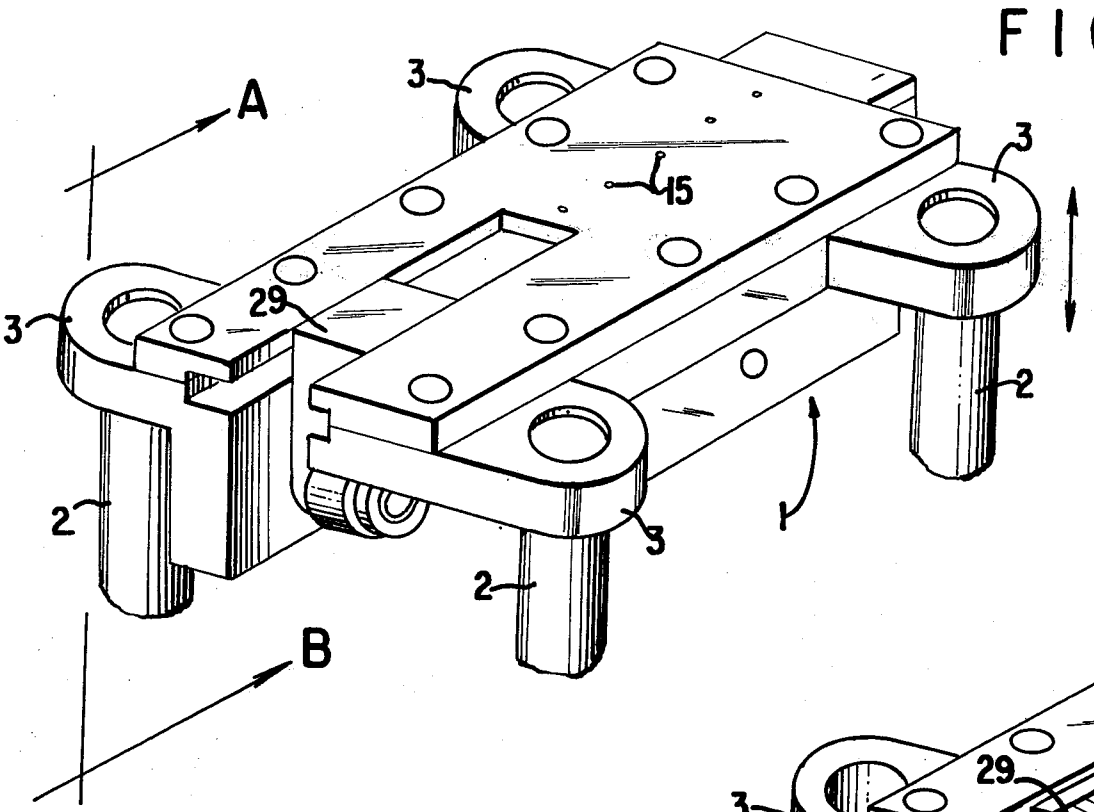
Figure 2:
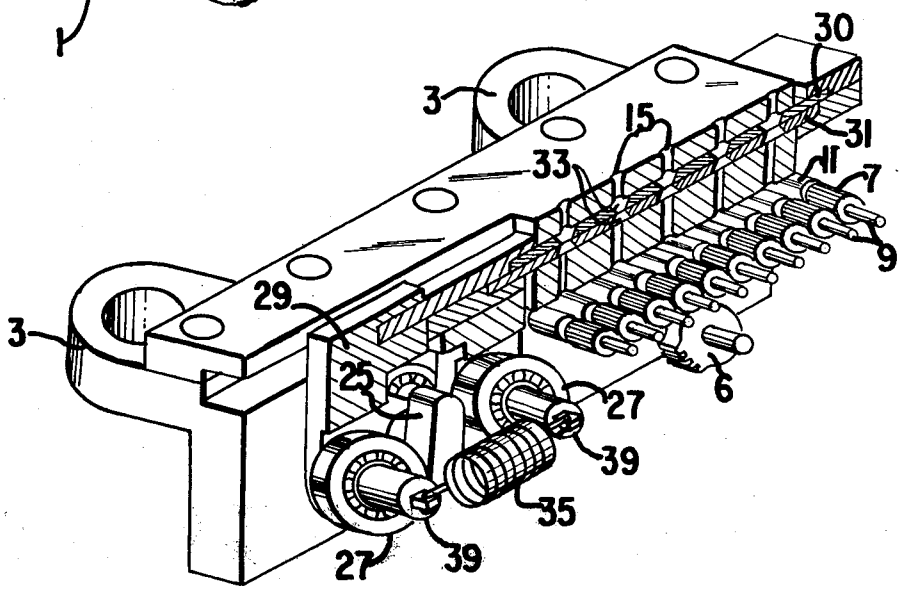

In the figures, where like reference numerals indentify like parts, 1 is, for example, a cam, a cam plate, a pneumatic or hydraulic lifting cylinder or a magnetic lifting mechanism for effecting the lifting movement of the thread introduction device shown in FIGS. 1. 2 are guide rods on which the thread guide device slides back and forth by means of bearing bush 3. 4 represents a foil with the pre-shaped halves of the single-dose containers 4*a*. The threads are designated by the reference numeral 5. 6 is a toothed segment which effects the advance of the threads, and this toothed segment drives the intermeshing pinions 7. The thread feed can also be effected by a feed ram carrying a rack and driven by a cam plate which drives the intermeshing pinions.

Pinions 7 are mounted on axles 9 on which the thread guide rollers 11 are mounted. The threads are guided through nozzles 15 which are provided with rounded collecting apertures 13 at the bottom. 17 represents sealing jaws which weld together the two symmetrically guided foils in the area 19 indicated by cross hatching. The threads are welded into the foils at 21. 23 represents the wound thread strand. Cam 25 moves apart the two ball races 27 or the toggle lever 28 and therefore the two knife holders 29, or rotates cutting bolt 37 relative to cutting tube 38. The knife holders and ball races are positioned on spindles 39. As a result, upper knife 30 is displaced in one direction and lower knife 31 in the other direction. 33 are cutting holes, and 35 is the spring which moves the knife holder 29 back into the original position. The enveloped lower end of the foil is designated by 4*b*. The thread collecting tube 40 is shown in the mounted position without its attachment and guide. 42 are mounting screws for the toggle lever and cutting bolt. The cutting bolt and cutting tube can easily be replaced by loosening screws 42 and 43. The conical holes in the bolt are designated by 44 and the slots in the cutting tube by 45. A stop pin ensures the precise superimposition of the thread guide holes in the zero position. The complete device is driven for example by the two bevel gears 47. 48 designates the thread guide holes. Any movement directions are indicated by the arrows shown in the figures. In Figs. *3a–3c* in each case five single-dose containers are simultaneously equipped with opening threads and subsequently presealed.

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

We claim:

1. An apparatus for making a package, said apparatus comprising:

means for longitudinally advancing into a joining station a pair of foils at least one of which is formed with a succession of pockets and for aligning said foils in said station with one of said pockets of said one foil opening in a first direction transverse to the longitudinal advance direction toward the other foil with said foils spaced apart at said one pocket;

means including a support reciprocal in a second direction transverse to said first transverse direction and to said longitudinal direction for displacing into said station the free end of a wire and for positioning said free end between the spaced-apart and aligned foils within the bounds of said one pocket;

means including a pair of dies displaceable in said first transverse direction for pressing and sealing together said foils around said one pocket while leaving said one pocket open at its side opposite said wire in the second transverse direction, whereby fluent material can be introduced through said side into and held between said foils in said one pocket; and means including at least one cutting element for severing from said wire a section at said free end.

2. The apparatus defined in claim 1, wherein said means including a support, includes a guide forming a passage through which said wire extends.

3. The apparatus defined in claim 2, wherein said means including said cutting element, includes two such cutting elements constituted as a pair of juxtaposed blades formed with alignable throughgoing holes constituting part of said passage, and includes means for oppositely reciprocating said blades and thereby misaligning said blades to sever said wire at said holes.

4. The apparatus defined in claim 3, wherein said means including said cutting element includes at least one spring biasing said blades into a position with said holes aligned.

5. The apparatus defined in claim 2 wherein said cutting element is a bolt formed with a thoroughgoing hole constituting part of said passage, said guide snugly surrounding said bolt at said hole, said means including said element also including means for periodically rotating said bolt in said guide for misaligning said hole with said passage and thereby cutting said wires passing therethrough.

6. The apparatus defined in claim 5, wherein said guide only closely surrounds said bolt at one end of said hole, the other end of said hole being spaced from said guide, whereby said wire is cut only at said one end.

* * * * *

UNITED STATES PATENT AND TRADEMARK OFFICE

CERTIFICATE OF CORRECTION

PATENT NO. : 4,257,838

DATED : March 24, 1981

INVENTOR(S) : PETER ASP ET AL.

It is certified that error appears in the above—identified patent and that said Letters Patent is hereby corrected as shown below:

Column 3, line 58: "sequence longitudinal: advance" should read -- sequence: longitudinal advance --.

line 61: "threads wires or" should read -- wires or threads --.

Figure 3A:
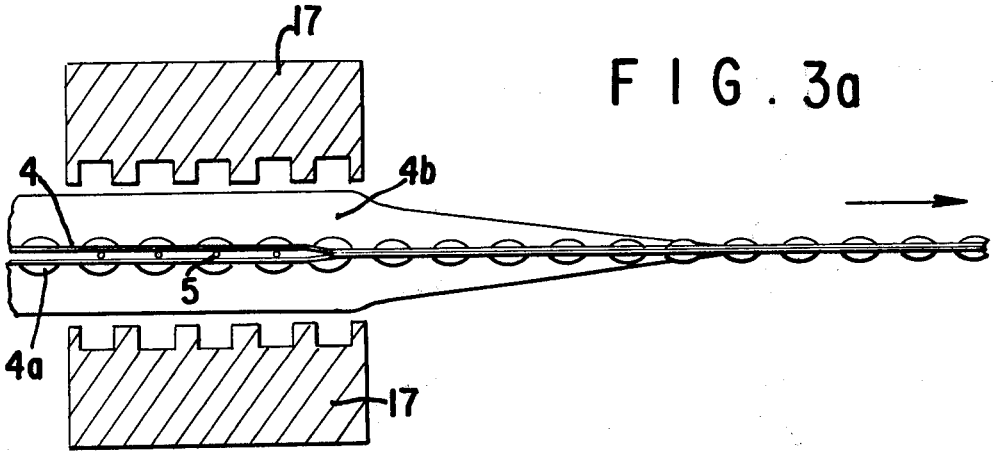
Figure 3B:
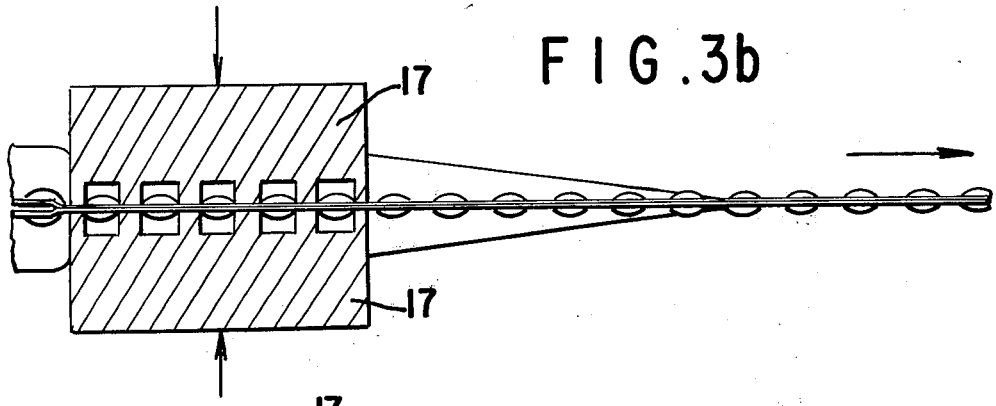
Figure 3C:
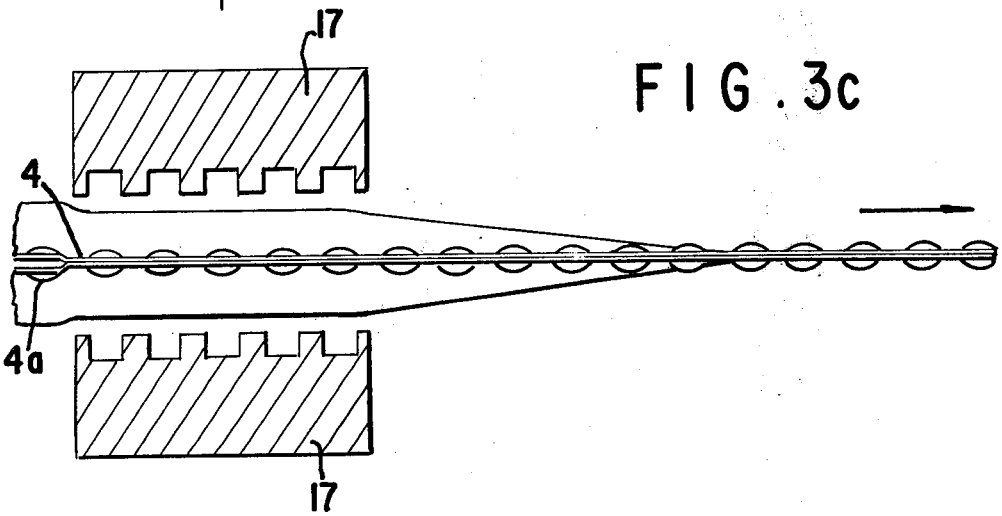
Figure 4:
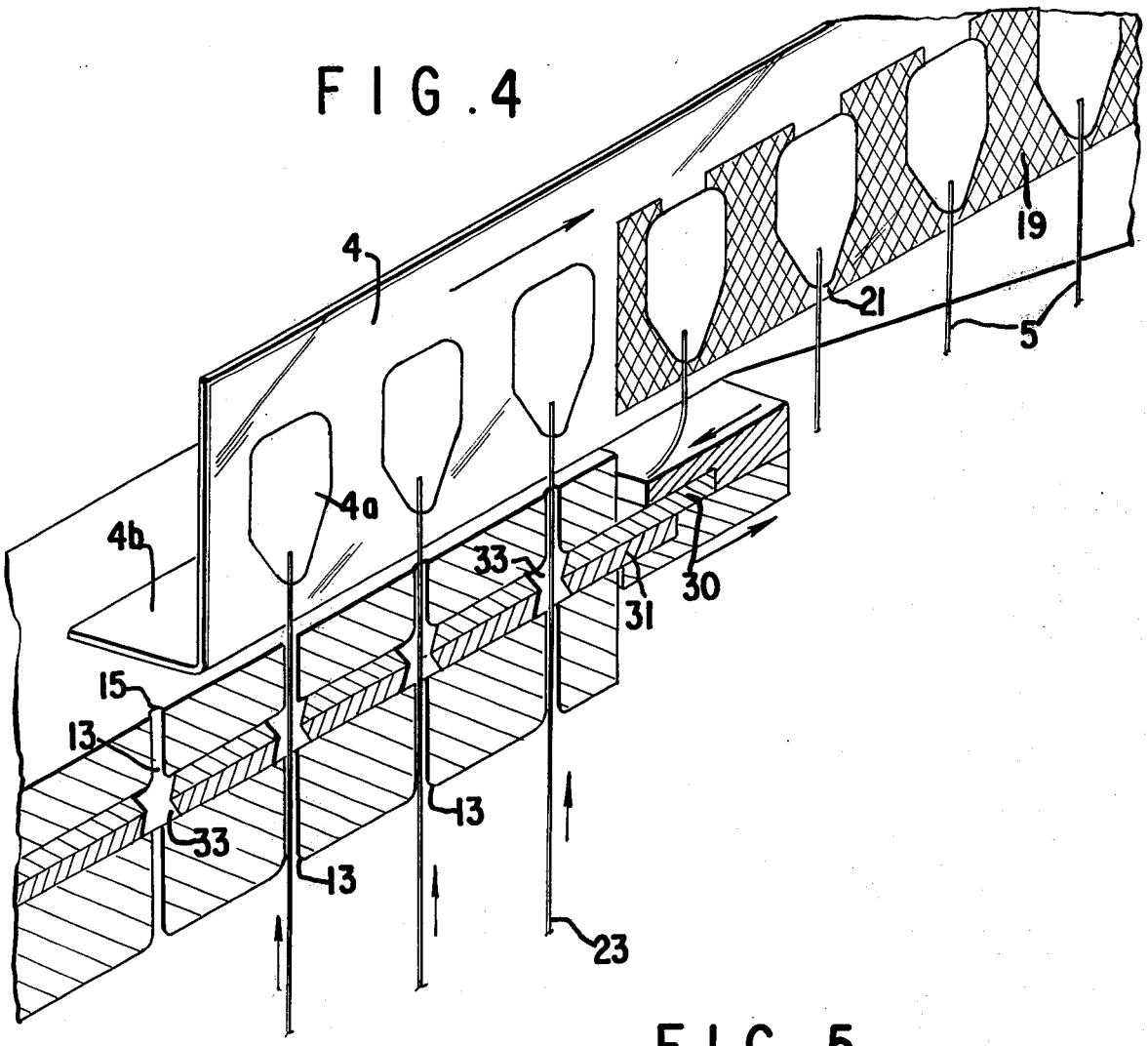
FIG. 4 shows a perspective section through the AB plane of FIG. 1, supplemented by one side of the foil strips and restricted to the cutting system.
Figure 5:
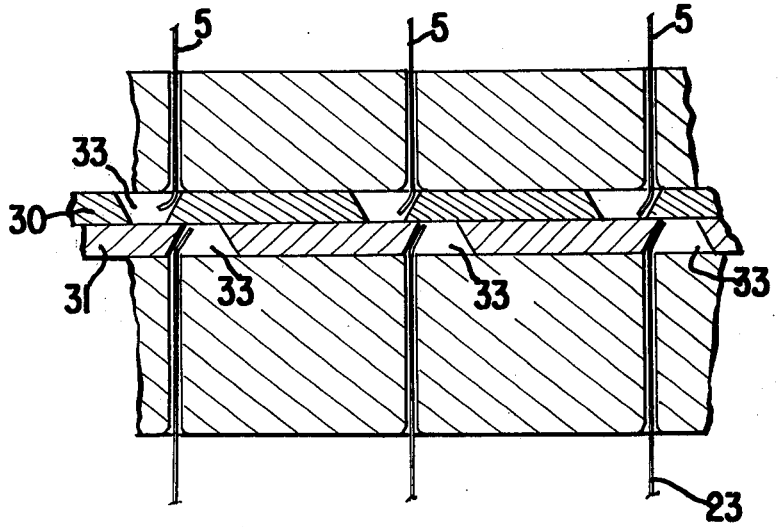
FIG. 5 shows a section through the cutting system in operation.
Figure 6:
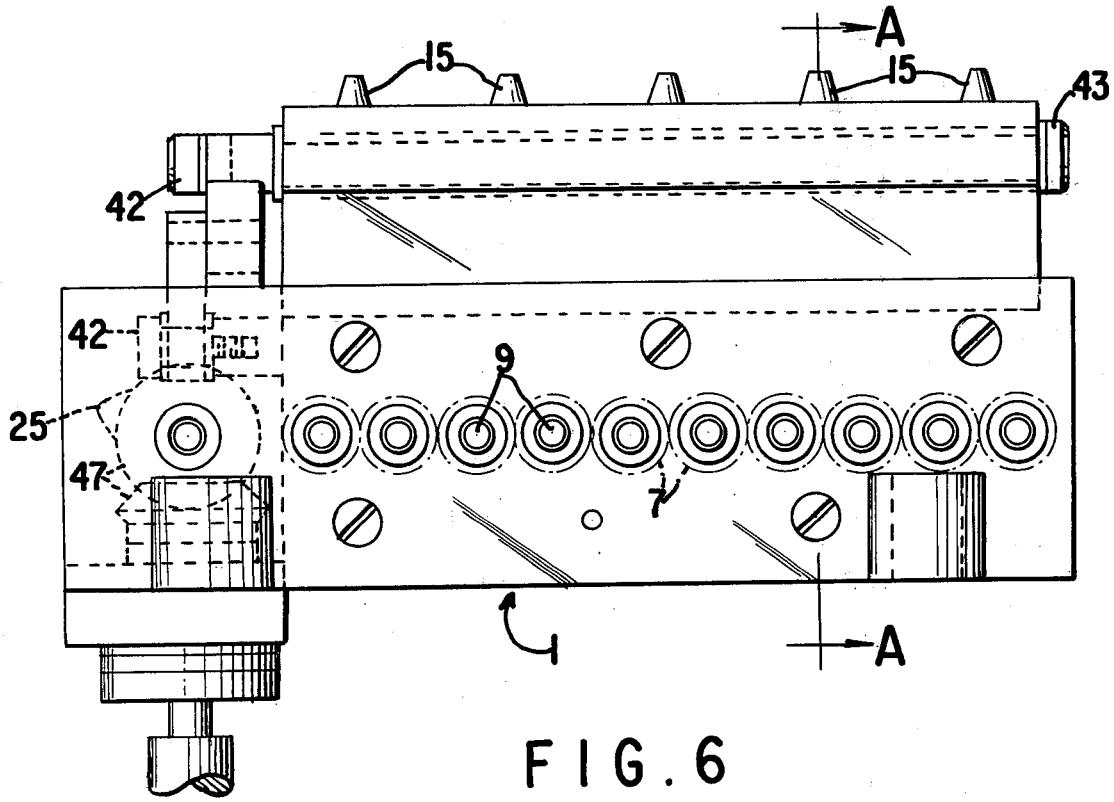
FIGS. 6 and 7 show a side view and a plan view, respectively, of a further embodiment of the thread introduction device.
Figure 7:
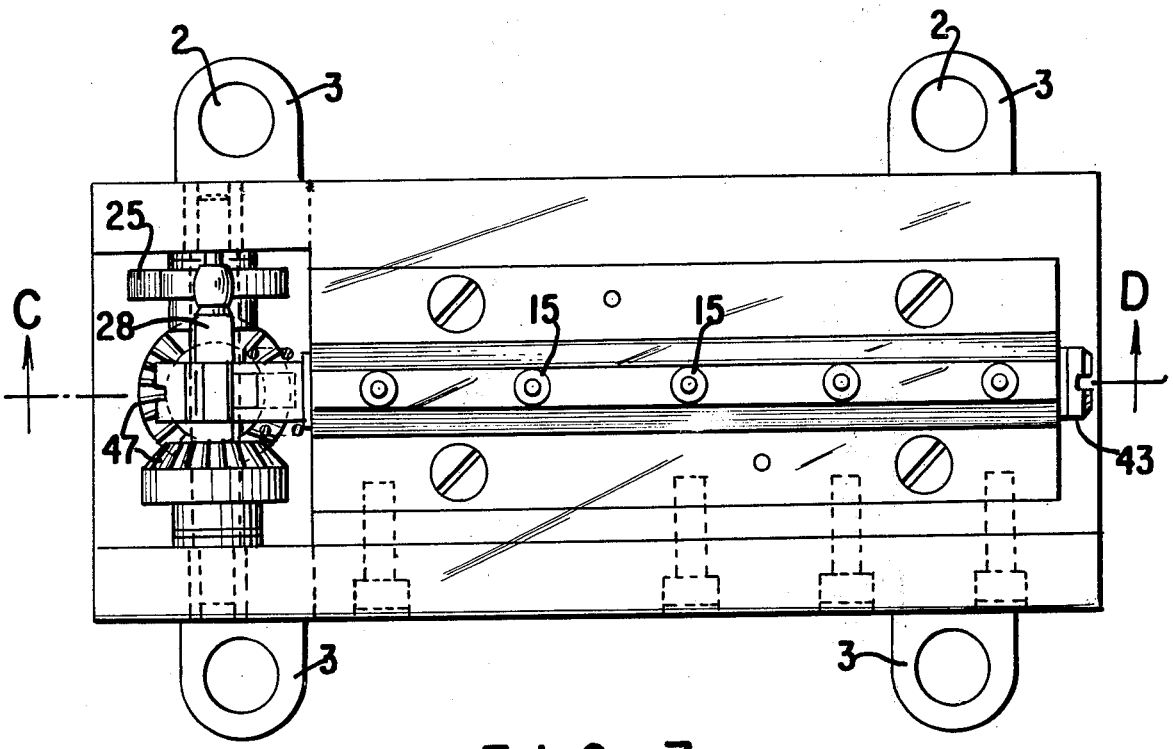
Figure 8:
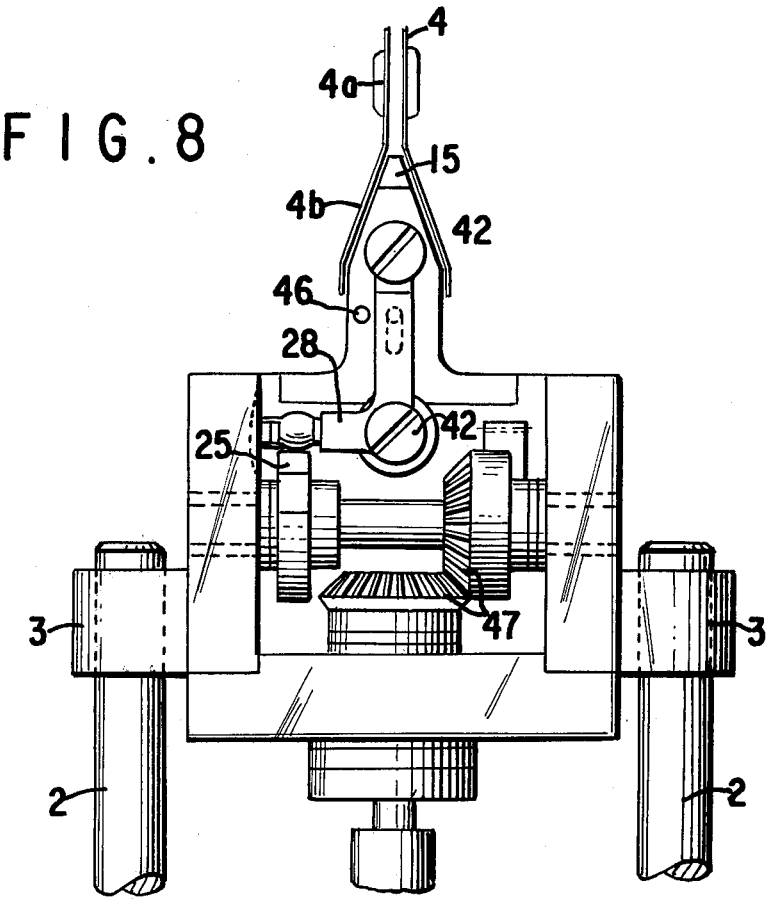
FIG. 8 shows the corresponding front view.
Figure 9:
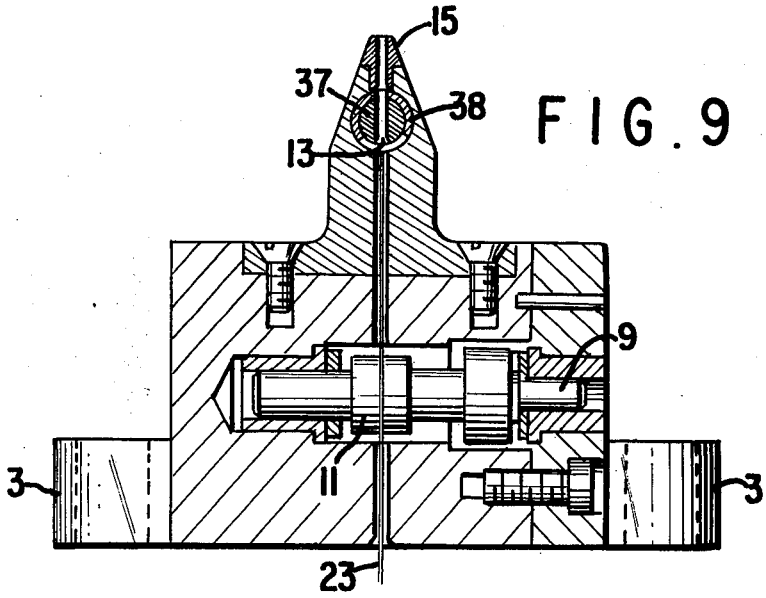
FIG. 9 shows a section through this device along sectional plane AB of FIG. 6.
Figure 10:
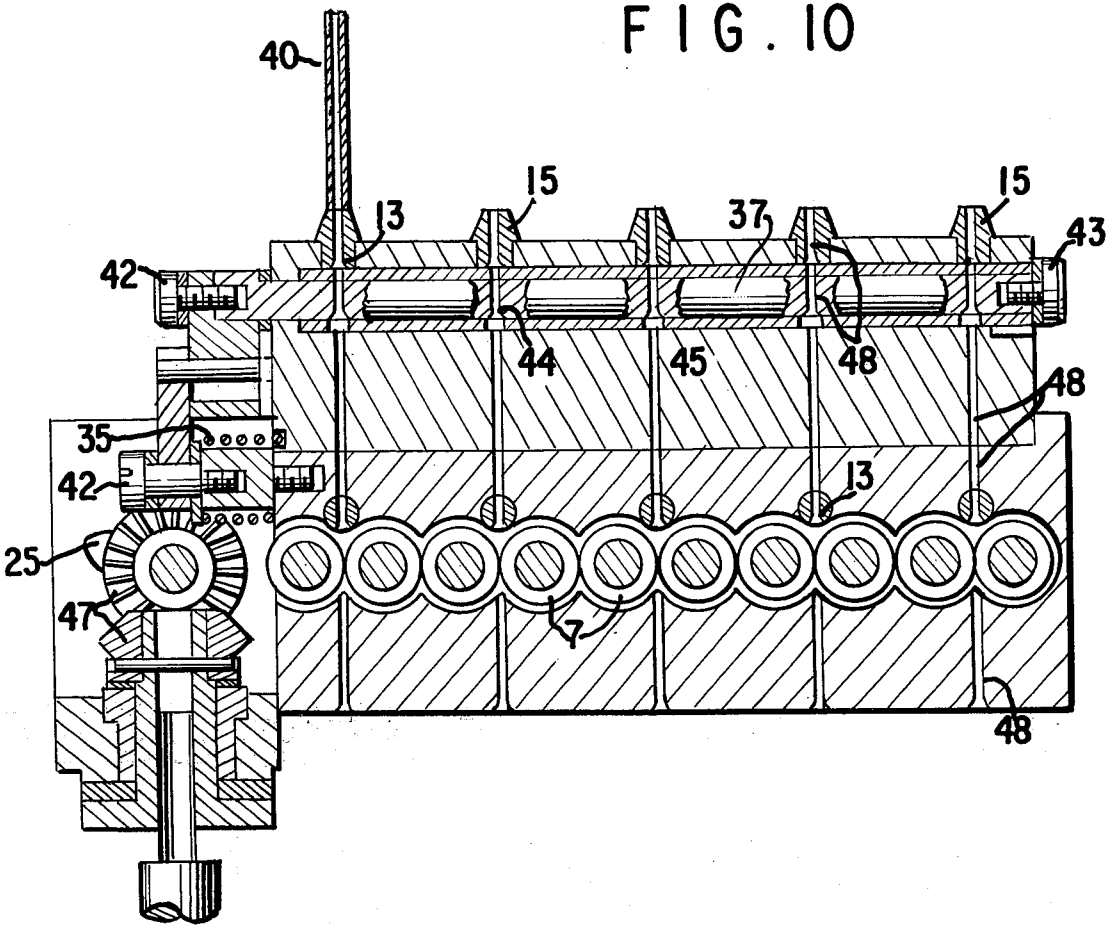
FIG. 10 is a section along sectional plane CD of FIG. 7.

Column 4, line 11: "FIG. 3" should read -- FIG. 3a --.

Signed and Sealed this

*Fourteenth* Day of *July 1981*

[SEAL]

*Attest:*

GERALD J. MOSSINGHOFF

*Attesting Officer*

*Commissioner of Patents and Trademarks*